US009508508B2

(12) United States Patent
Takaya et al.

(10) Patent No.: US 9,508,508 B2
(45) Date of Patent: Nov. 29, 2016

(54) SWITCH INCLUDING AN ARC EXTINGUISHING CONTAINER WITH A METAL BODY AND A RESIN COVER

(71) Applicants: FUJI ELECTRIC FA COMPONENTS & SYSTEMS CO., LTD., Chuo-ku, Tokyo (JP); FUJI ELECTRIC CO., LTD., Kawasaki-shi, Kanagawa (JP)

(72) Inventors: Kouetsu Takaya, Kounosu (JP); Kenji Suzuki, Kounosu (JP); Yasuhiro Naka, Kounosu (JP)

(73) Assignees: FUJI ELECTRIC FA COMPONENTS & SYSTEMS CO., LTD., Tokyo (JP); FUJI ELECTRIC CO., LTD., Kawasaki-Shi (JP)

( * ) Notice: Subject to any disclaimer, the term of this patent is extended or adjusted under 35 U.S.C. 154(b) by 148 days.

(21) Appl. No.: 14/504,958

(22) Filed: Oct. 2, 2014

(65) Prior Publication Data

US 2015/0022296 A1 Jan. 22, 2015

Related U.S. Application Data

(63) Continuation of application No. PCT/JP2013/002472, filed on Apr. 11, 2013.

(30) Foreign Application Priority Data

Apr. 13, 2012 (JP) ..... 2012-092449

(51) Int. Cl.
*H01H 33/18* (2006.01)
*H01H 50/04* (2006.01)
(Continued)

(52) U.S. Cl.
CPC ..... *H01H 33/182* (2013.01); *H01H 50/023* (2013.01); *H01H 50/04* (2013.01);
(Continued)

(58) Field of Classification Search
CPC .... H01H 50/04; H01H 50/38; H01H 50/023; H01H 50/546; H01H 33/182
See application file for complete search history.

(56) References Cited

U.S. PATENT DOCUMENTS 5,892,194 A 4/1999 Uotome et al.
7,023,306 B2 4/2006 Nishida et al.
(Continued)

FOREIGN PATENT DOCUMENTS

CN 1637993 A 7/2005
CN 101978453 A 2/2011
(Continued)

OTHER PUBLICATIONS

Europe Patent Office, "Search Report for EP 13775676.3," Nov. 20, 2015.
(Continued)

*Primary Examiner* — Bernard Rojas
(74) *Attorney, Agent, or Firm* — Manabu Kanesaka

(57) ABSTRACT

A switch has a pair of fixed contacts installed in an arc extinguishing container and disposed to maintain a predetermined space therebetween, and a movable contact disposed so as to come into and out of contact with the pair of fixed contacts. The arc extinguishing container includes an open-topped tub-shaped metal body, an insulating holding member which holds the pair of fixed contacts, disposed on an inner side of the tub-shaped metal body, opposite to the movable contact, and an open-bottomed tub-shaped resin cover which covers the pair of fixed contacts and the movable contact from an open edge face side of the tub-shaped metal body. A periphery of an open edge of the resin cover is sealed to a bottom surface of the tub-shaped metal body with an adhesive agent.

6 Claims, 5 Drawing Sheets

(51) Int. Cl.

| | |
|---|---|
| ***H01H 50/38*** | (2006.01) |
| ***H01H 50/02*** | (2006.01) |
| ***H01H 50/54*** | (2006.01) |
| *H01H 50/14* | (2006.01) |

(52) U.S. Cl.

CPC ..... *H01H 50/38* (2013.01); *H01H 50/546* (2013.01); *H01H 50/14* (2013.01); *H01H 2050/025* (2013.01); *H01H 2223/002* (2013.01); *H01H 2223/008* (2013.01)

(56) References Cited

U.S. PATENT DOCUMENTS

| | | | | |
|---|---|---|---|---|
| 7,911,304 | B2 | 3/2011 | Yano et al. | |
| 8,222,980 | B2 * | 7/2012 | Yamagata | H01H 50/023 335/126 |
| 8,395,463 | B2 | 3/2013 | Ito et al. | |
| 8,446,240 | B2 | 5/2013 | Swartzentruber et al. | |
| 8,642,906 | B2 | 2/2014 | Yeon | |
| 8,947,183 | B2 | 2/2015 | Yano et al. | |
| 2005/0072591 | A1 | 4/2005 | Hayase et al. | |
| 2006/0050466 | A1 | 3/2006 | Enomoto et al. | |
| 2008/0084260 | A1 * | 4/2008 | Swartzentruber | H01H 50/023 335/151 |
| 2010/0060392 | A1 * | 3/2010 | Cho | H01H 50/023 335/124 |
| 2010/0289604 | A1 | 11/2010 | Kojima et al. | |
| 2013/0335175 | A1 * | 12/2013 | Tachikawa | H01H 1/54 335/147 |
| 2014/0176268 | A1 | 6/2014 | Suzuki et al. | |
| 2015/0015350 | A1 | 1/2015 | Tachikawa et al. | |
| 2015/0022291 | A1 | 1/2015 | Kashimura et al. | |

FOREIGN PATENT DOCUMENTS

| | | | |
|---|---|---|---|
| EP | 0798752 | A2 | 10/1997 |
| EP | 2019405 | A1 | 1/2009 |
| EP | 2838099 | A1 | 2/2015 |
| JP | H07-335105 | A | 12/1995 |
| JP | H10-125196 | A | 5/1998 |
| JP | 2005-015773 | A | 1/2005 |
| JP | 2006-019148 | A | 1/2006 |
| JP | 2010-267470 | A | 11/2010 |
| JP | 2011-228087 | A | 11/2011 |
| JP | 2012-054047 | A | 3/2012 |
| KR | 101086907 | B1 | 11/2011 |
| WO | 2008/033349 | A2 | 3/2008 |
| WO | 2011/115049 | A1 | 9/2011 |

OTHER PUBLICATIONS

China Patent Office, "Office Action for CN 201380019152.X," Sep. 28, 2015.

PCT, International Search Report for International Application No. PCT/JP2013/002472.

* cited by examiner

SWITCH INCLUDING AN ARC EXTINGUISHING CONTAINER WITH A METAL BODY AND A RESIN COVER

CROSS-REFERENCE TO RELATED APPLICATION

This is a continuation application of PCT/JP2013/002472 filed on Apr. 11, 2013, which claims priority of Japanese Patent Application No. 2012-092449 filed on Apr. 13, 2012, the disclosure of which is incorporated herein.

TECHNICAL FIELD

The present invention relates to a switch wherein fixed contacts and a movable contact disposed so as to be able to come into and out of contact with the fixed contacts are installed in an arc extinguishing container.

BACKGROUND ART

As this kind of switch, for example, a terminal seal structure used in a switch device, such as an electromagnetic contact, a switch, or a timer, described in PTL 1 is known. In the seal structure, a seal case in which a contact mechanism can be housed and a seal cover which closes the top of the seal case, are formed of a seal case block made of a metal. Further, the seal structure is a terminal seal structure wherein a pair of insertion holes into which the connection terminals of a contact mechanism block are inserted, are formed in the seal cover, and sealing is provided by injecting and solidifying a seal material in a condition in which the connection terminals are inserted in the pair of insertion holes. Also, the thermal expansion coefficient of the seal material is set to be equal to or higher than the linear expansion coefficient of the seal case block by adding an inorganic filler to a liquid thermosetting polymer.

CITATION LIST

Patent Literature

PTL 1: JP-A-2005-15773

SUMMARY OF INVENTION

Technical Problem

Meanwhile, in the heretofore known example described in the PTL 1, an insulating case is disposed in a cylindrical seal case block, a seal cover is disposed on the top of the seal case block, terminal holes are formed in the seal cover, and in a condition in which terminals are disposed in the terminal holes, a seal material is injected into spaces between the terminal holes and the terminals and solidified, thus forming an arc extinguishing container.

When injecting the seal material into the spaces between the terminal holes and the terminals, and solidifying the seal material, after forming the terminal holes in the seal cover and disposing the terminals in the terminal holes, in this way, there is a need for a comparatively large injection pressure in order to completely spread the seal material into all insertion portions. Because of this, there is an unsolved problem that it is necessary to precisely form the portions into which the seal material is injected in order not to leak the seal material, thus leading to an increase in molding cost.

Therefore, the invention, focusing attention on the unsolved problem of the heretofore known example, has an object of providing a switch wherein it is possible to easily form an arc extinguishing container which seals a contact mechanism in a condition in which the arc extinguishing container is enclosing the contact mechanism.

Solution to Problem

In order to achieve the object, in a first aspect of a switch according to the invention, provided is a switch having a pair of fixed contacts disposed to maintain a predetermined space therebetween and a movable contact disposed so as to come into and out of contact with the pair of fixed contacts, the pair of fixed contacts and the movable contact being installed in an arc extinguishing container. Further, the arc extinguishing container includes an open-topped tub-shaped metal body, an insulating holding member which holds the pair of fixed contacts, disposed on an inner side of the tub-shaped metal body, opposite to the movable contact, and an open-bottomed tub-shaped resin cover which covers the pair of fixed contacts and the movable contact from an open edge face side of the tub-shaped metal body. Furthermore, a periphery of an open edge of the resin cover is sealed to a bottom surface of the tub-shaped metal body with an adhesive agent.

According to this configuration, when forming a highly airtight arc extinguishing container, it is possible, without carrying out welding such as projection welding or laser welding, to provide sealing by disposing the insulating holding member, which holds the pair of fixed contacts, on an inner surface side of the tub-shaped metal body, disposing the tub-shaped resin cover so as to enclose the pair of fixed contacts held by the insulating holding member, and fixing the periphery of the open edge of the resin cover with the adhesive agent. Because of this, it is possible to easily and reliably form a highly airtight arc extinguishing container without carrying out joining wherein heat is applied, such as welding or brazing.

Moreover, as the tub-shaped metal body and resin cover are adhered by the adhesive agent, it is not necessary to inject while applying pressure, such as injecting a sealant, and it is possible to easily adhere the resin cover and tub-shaped metal body.

Also, in a second aspect of the switch according to the invention, each of the pair of fixed contacts has a U-shaped bend portion formed between a contact portion opposite to the movable contact and an external connection terminal portion, the insulating holding member is formed of contact holding portions in which the U-shaped bend portions of the pair of fixed contacts are inserted and held, and the resin cover is fixed by an adhesive agent with the side surfaces of the resin cover inserted in the U-shaped bend portions of the pair of fixed contacts.

According to the second aspect, as each of the pair of fixed contacts has the U-shaped bend portion formed between the contact portion opposite to the movable contact and the external connection terminal portion, the U-shaped bend portions are held by the contact holding portions, and the U-shaped bend portions are inserted into the side surfaces of the resin cover and fixed by an adhesive agent; it is possible to easily carry out the fixing of the pair of fixed contacts.

Also, in a third aspect of the switch according to the invention, magnet holding portions which hold arc extinguishing permanent magnets are formed in the insulating holding member so as to be opposite to the contact portions of the pair of fixed contacts and the contact portions of the movable contacts.

According to the third aspect, as the arc extinguishing permanent magnets are disposed in the insulating holding member, it is possible to extend arcs in a predetermined direction, and it is possible to easily and reliably carry out extinguishing of the arcs.

Also, in a fourth aspect of the switch according to the invention, an electromagnet device which moves the movable contact such that the movable contact comes into and out of contact with the pair of fixed contacts, is disposed on the lower surface side of the tub-shaped metal body.

According to the fourth aspect, as the electromagnet device is disposed on the lower surface side of the tub-shaped metal body, it is possible, with the electromagnet device, to move the movable contact such that the movable contact comes into and out of contact with the pair of fixed contacts, and it is possible to configure an electromagnetic contactor acting as an electromagnetic switch.

Advantageous Effects of Invention

According to the invention, the insulating holding member which holds the pair of fixed contacts opposite the movable contact, is disposed in the tub-shaped metal body, the pair of fixed contacts and the movable contact are covered with the tub-shaped resin cover from the open edge side of the tub-shaped metal body, and the periphery of the open edge of the resin cover is sealed to the bottom surface of the tub-shaped metal body with an adhesive agent. Because of this, it is possible to easily form a highly airtight arc extinguishing container simply by adhering the tub-shaped metal body and the resin cover with an adhesive agent without carrying out a joining process necessary for heating, such as projection welding, laser welding, or brazing.

DESCRIPTION OF EMBODIMENTS

Hereafter, a description will be given, based on the drawings, of an embodiment of the invention.

Figure 1:
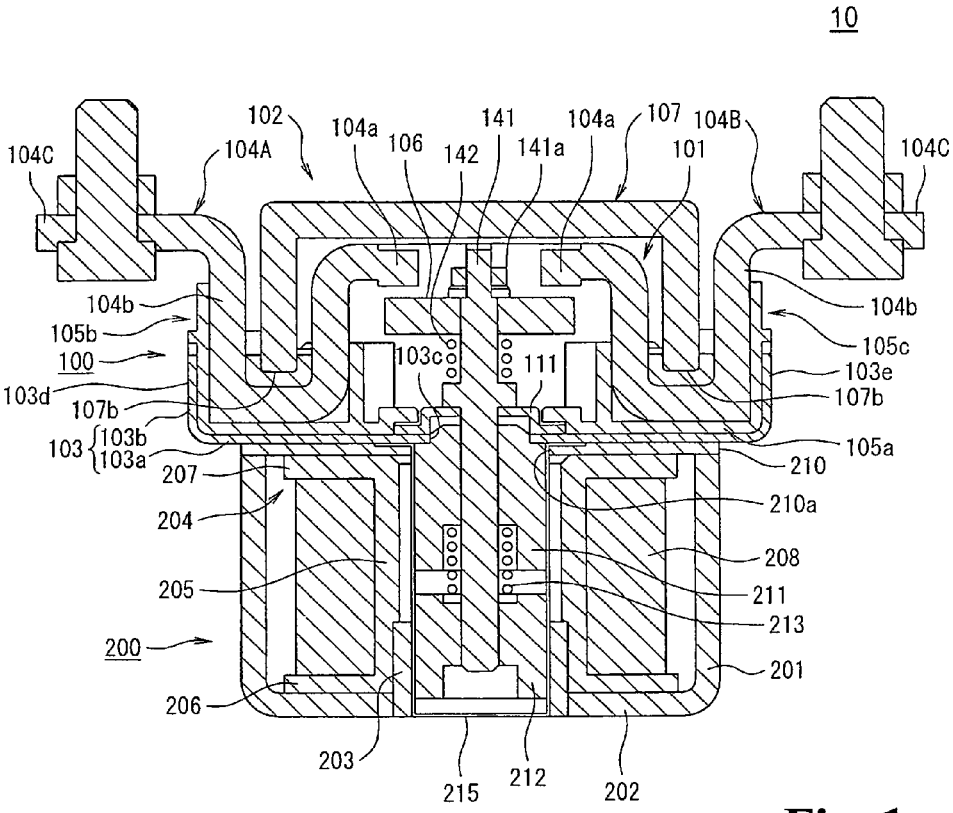
FIG. 1 is a sectional view showing an embodiment of an electromagnetic contactor according to the invention.
Figure 2:
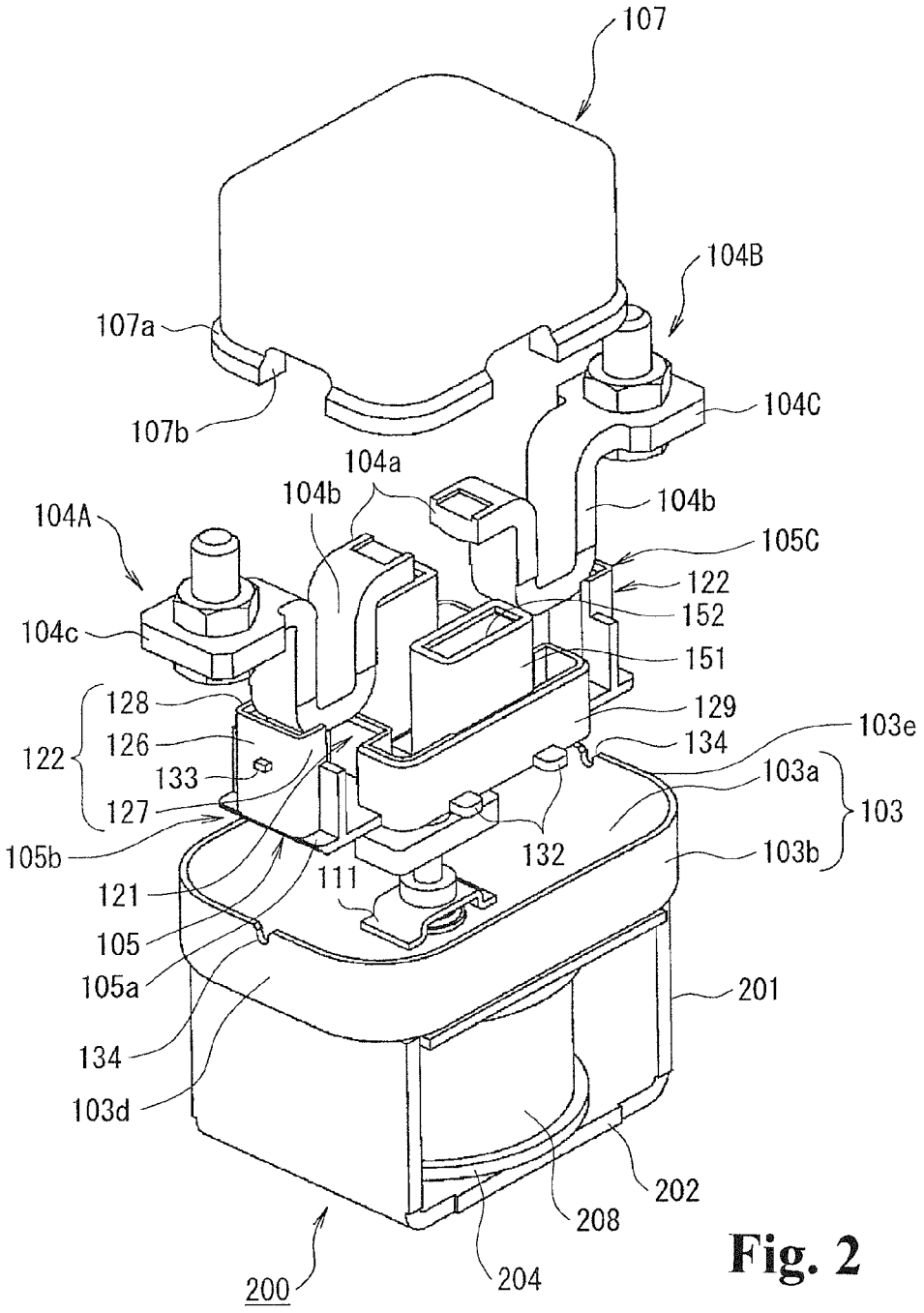
FIG. 2 is an exploded perspective view showing the embodiment of the electromagnetic contactor according to the invention.
Figure 3:
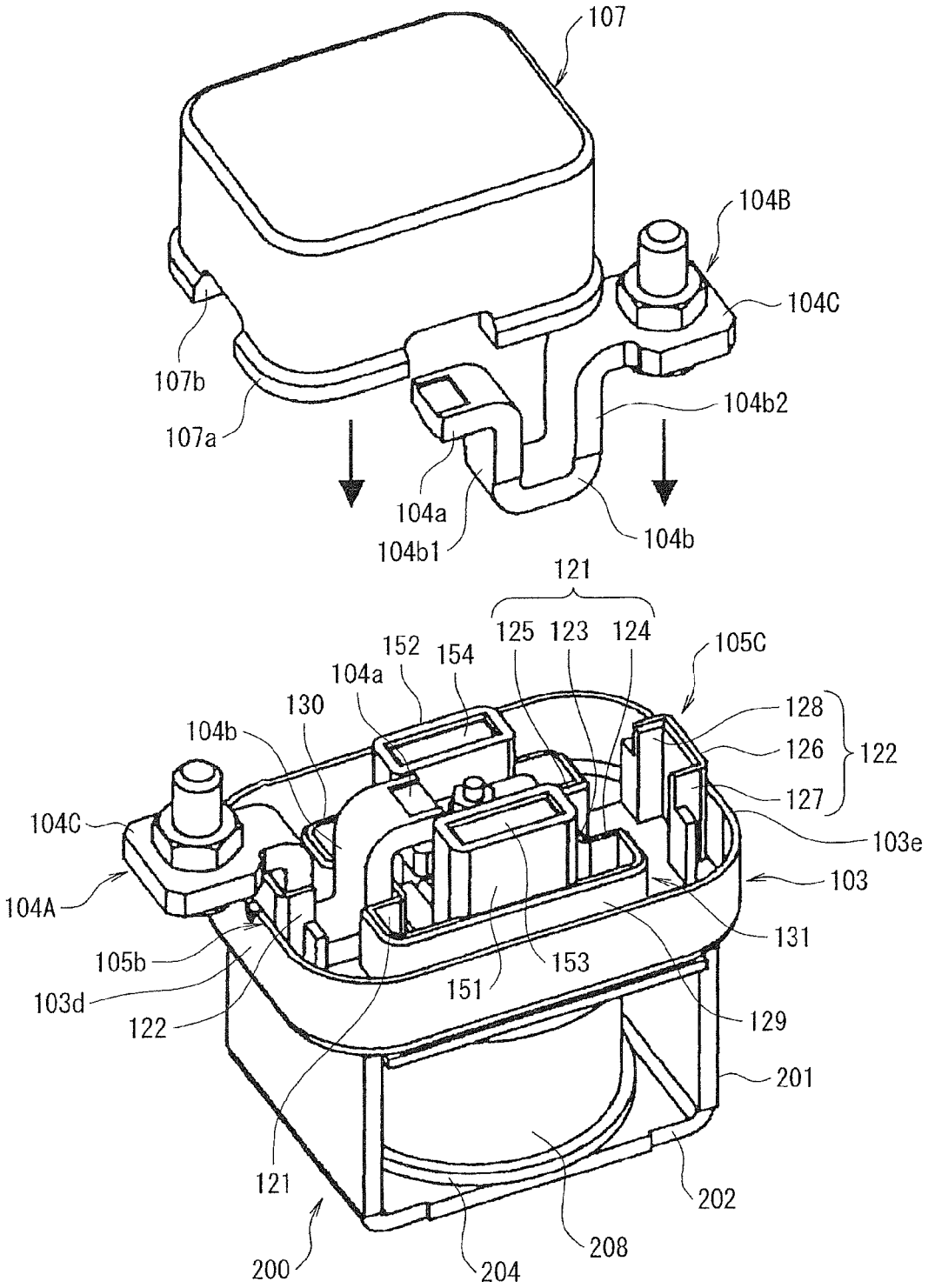
FIG. 3 is a perspective view showing a condition in which fixed contacts of the electromagnetic contactor according to the invention are mounted.

FIG. 1 is a sectional view showing one example of an overall configuration of an electromagnetic contactor acting as a switch according to the invention, FIG. 2 is an exploded perspective view showing one example of the electromagnetic contactor according to the invention, and FIG. 3 is a perspective view showing a condition in which fixed contacts are mounted.

In FIG. 1, 10 is an electromagnetic contactor acting as a switch, and the electromagnetic contactor 10 includes a contact device 100 in which a contact mechanism is disposed and an electromagnet device 200 which drives the contact device 100.

The contact device 100 has an arc extinguishing container 102 housing the contact mechanism 101, as clearly shown in FIG. 1. The arc extinguishing container 102 has an open-topped tub-shaped metal body 103 wherein a metal plate material, such as aluminum, an aluminum alloy, or stainless steel, is molded into a tub shape by press molding, as shown in FIGS. 1 to 3.

Also, the arc extinguishing container 102 has an insulating holding member 105, made of, for example, a synthetic resin, which holds a pair of fixed contacts 104A and 104B disposed in the tub-shaped metal body 103. Furthermore, the arc extinguishing container 102 has a open-bottomed tub-shaped resin cover 107 which is inserted from the open edge face side of the tub-shaped metal body 103 to cover the pair of fixed contacts 104A and 104B and a movable contact 106 disposed so as to be able to come into and out of contact with the pair of fixed contacts 104A and 104B.

The tub-shaped metal body 103 includes a substantially rectangular bottom plate portion 103*a* and a rectangular cylindrical portion 103*b* extending upward from the outer peripheral edge of the bottom plate portion 103*a*. The bottom plate portion 103*a* has an insertion hole 103*c*, formed in the central portion thereof, through which one portion of a fixed iron core of the electromagnet device 200 to be described hereafter is inserted. A positioning piece 111 which restricts the lower end position of a movable shaft by contacting with the lower end of a flange portion formed on the movable shaft, the movable shaft extending upward through the central portion of the fixed iron core and supporting the movable contact 106 with a contact spring at the upper end thereof, is fixed on the upper side of the insertion hole 103*c*.

The pair of fixed contacts 104A and 104B are formed in a symmetrical shape. Each of the pair of fixed contacts 104A and 104B includes a horizontal contact portion 104*a* disposed in the central portion of the arc extinguishing container 102 and opposite to the contact portion of the movable contact 106, a U-shaped bend portion 104*b* extending downward from the outer side end of the contact portion 104*a*, and a connection terminal portion 104*c* extending horizontally outward from the other end side of the U-shaped bend portion 104*b*.

As particularly clearly shown in FIGS. 2 and 3, the insulating holding member 105 includes a bottom plate portion 105*a*, disposed in contact with the inner surfaces of side plate portions 103*d* and 103*e* on the short edge sides of the tub-shaped metal body 103, and contact holding portions 105*b* and 105*c*, formed opposite to the side plate portions 103*d* and 103*e*, which hold the pair of fixed contacts 104A and 104B on the upper surface of the bottom plate portion 105*a*.

Herein, each of the contact holding portions 105*b* and 105*c* includes mutually opposing inner side tub-shaped portion 121 and outer side tub-shaped portion 122, extending in an up-down direction, in which vertical plate portions of the U-shaped bend portions 104*b* of the pair of fixed contacts 104A and 104B are inserted and held.

The inner side tub-shaped portion 121 includes a central plate portion 123 which extends in the up-down direction so as to be parallel to, while maintaining a predetermined distance from, the side plate portions 103*d* and 103*e* of the tub-shaped metal body 103, and the upper end of which protrudes above the upper end of the tub-shaped metal body 103, and a pair of side plate portions 124 and 125 protruding rightward from the front and rear end portions of the central plate portion 123.

The outer side tub-shaped portion 122 includes a central plate portion 126 which extends in the up-down direction along one of the side plate portions 103*d* and 103*e* of the tub-shaped metal body 103, and the upper end of which protrudes above the upper end of the tub-shaped metal body 103, and a pair of side plate portions 127 and 128 protruding leftward from the front and rear end portions of the central plate portion 126.

A cylindrical portion 131 is formed by side plate portions 124 and 125 of the inner side tub-shaped portions 121 of the contact holding portions 105*b* and 105*c* integrally linked by sidewall portions 129 and 130 bulging in forward and backward directions. Also, engaging pieces 132, protruding outward to engage with the inner surface of the rectangular cylindrical portion 103*b* of the tub-shaped metal body 103, are formed on the lower surface side of each sidewall portion 129 and 130.

Furthermore, engaging pieces 133 protruding outward are formed on each of the side surfaces of the central plate portions 126 of the outer side tub-shaped portions 122 of the contact holding portions 105*b* and 105*c*. The engaging pieces 133 are engaged with respective engaging recessed portions 134 formed in each of the upper edges on the short edge sides of the rectangular cylindrical portion 103*b* of the tub-shaped metal body 103.

Further, the pair of fixed contacts 104A and 104B is inserted from above and held in the contact holding portions 105*b* and 105*c*, as shown in FIG. 3. To describe the fixed contact 104B with regard to the insertion and holding of the fixed contacts 104A and 104B, the fixed contact 104B is held, as shown in FIG. 3. That is, the fixed contact 104B is inserted from above so that an inner side vertical plate portion 104*b*1 of the U-shaped bend portion 104*b* of the fixed contact 104B is engaged on the inner sides of the central plate portion 123 and side plate portions 124 and 125 of the inner side tub-shaped portion 121 of the contact holding portion 105*c*, and that an outer side vertical plate portion 104*b*2 of the U-shaped bend portion 104*b* is engaged with the central plate portion 126 and side plate portions 127 and 128 of the outer side tub-shaped portion 122.

The fixed contact 104A is also inserted and held in the contact holding portion 105*b* in the same way as heretofore described.

The resin cover 107 has a peripheral flange portion 107*a*, formed on the open edge face of the lower edge thereof, which has a wall thickness larger than that of the other portion and secures an adhesion area with the thick wall thickness of the other portion. Also, notch portions 107 into which the bottom portions of the U-shaped bend portions 104*b* of the fixed contacts 104A and 104B are inserted, are formed in positions on the peripheral flange portion 107*a* opposite the fixed contacts 104A and 104B held in the contact holding portions 105*b* and 105*c*.

Further, the movable contact 106 is disposed such that the two left and right end portions thereof are opposite to the lower sides of the contact portions 104*a* of the fixed contacts 104A and 104B. The movable contact 106 is supported by a movable shaft 141 fixed in a movable iron core 212 of the electromagnet device 200, to be described hereafter.

The movable shaft 141 has a flange portion 141*a* protruding outward at the upper end thereof. A contact spring 142 which gives a predetermined contact pressure is inserted on the lower end side of the movable contact 106 of the movable shaft 141.

The movable contact 106, in a released state, attains a condition in which the contact portions of the two ends thereof are out of contact with, while maintaining a predetermined space from, the contact portions 104*a* of the fixed contacts 104A and 104B. Also, the movable contact 106 is set, in a closed position, such that the contact portions of the two ends thereof come into contact with the contact portions 104*a* of the fixed contacts 104A and 104B at a predetermined contact pressure applied by the contact spring 142.

Also, magnet holding portions 151 and 152 are formed in the previously described insulating holding member 105. The magnet holding portions 151 and 152 are opposite to the contact portions 104*a* of the fixed contacts 104A and 104B and the contact portions of the movable contact 106, from side surface sides in the front-rear direction, on the inner sides in the left-right direction of the contact holding portions 105*b* and 105*c* and in a condition in which the magnet holding portions 151 and 152 are holding the fixed contacts 104A and 104B. Arc extinguishing permanent magnets 153 and 154 are inserted and held in the magnet holding portions 151 and 152. The magnet holding portions 151 and 152 are disposed on the inner sides of the sidewall portions 129 and 130. The magnet holding portions 151 and 152 are covered with the previously described resin cover 107.

The arc extinguishing permanent magnets 153 and 154 are magnetized in a thickness direction so that the mutually opposing faces thereof are of the same pole, for example, N-poles. Also, the arc extinguishing permanent magnets 153 and 154 are set such that both end portions thereof in the left-right direction are slightly inward of the end portions of the left and right contact portions of the movable contact 106, as shown in FIG. 4. Further, two pairs of arc extinguishing spaces 155 and 156 are formed on each of the outer sides in the left-right direction of the magnet holding portions 151 and 152.

Figure 4A:
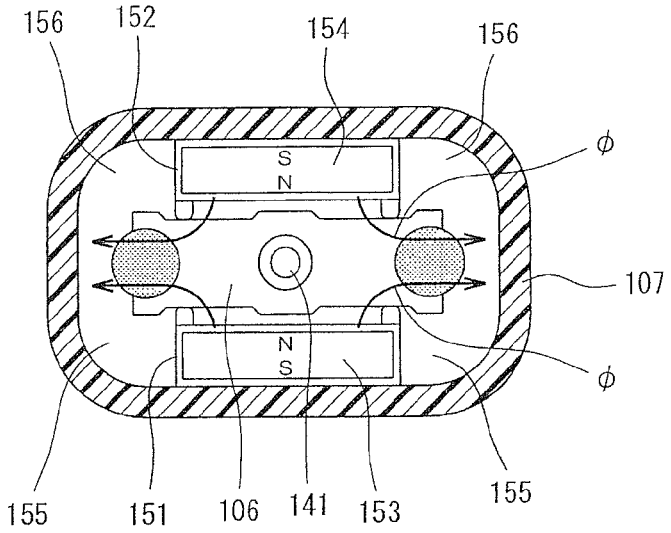
FIG. 4A to 4C are illustrations for illustrating arc extinguishing by arc extinguishing permanent magnets according to the invention.

By disposing the arc extinguishing permanent magnets 153 and 154 on the inner peripheral surface side of the resin cover 107 in this way, it is possible to bring the arc extinguishing permanent magnets 153 and 154 near to the movable contact 106. Because of this, as shown in FIG. 4A, magnetic fluxes $\phi$ emanating from the N-pole sides of the two arc extinguishing permanent magnets 153 and 154 cross portions in which the contact portions 104*a* of the fixed contacts 104A and 104B and the contact portions 106*a* of the movable contact 106 are opposed, in left and right directions, from the inner side to the outer side, with a high density of magnetic fluxes.

Figure 4B:
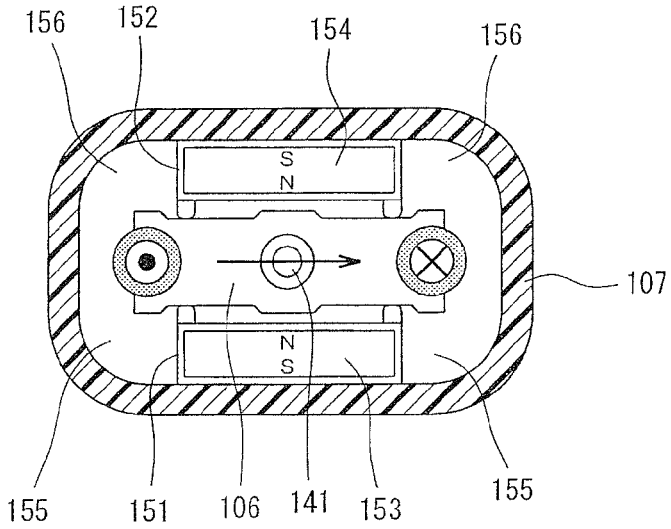

Consequently, assuming that the connection terminal portion 104*c* of the fixed contact 104A is connected to a power supply source and the fixed contact 104B is connected to a load side, the direction of current in the closed condition is such that the current flows from the fixed contact 104A through the movable contact 106 to the fixed contact 104B, as shown in FIG. 4B. Then, when shifting from the closed condition to the released condition by causing the movable contact 106 to move upward away from the fixed contacts 104A and 104B, arcs are generated between the contact portions 104*a* of the fixed contacts 104A and 104B and the contact portions 106*a* of the movable contact 106.

Figure 4C:
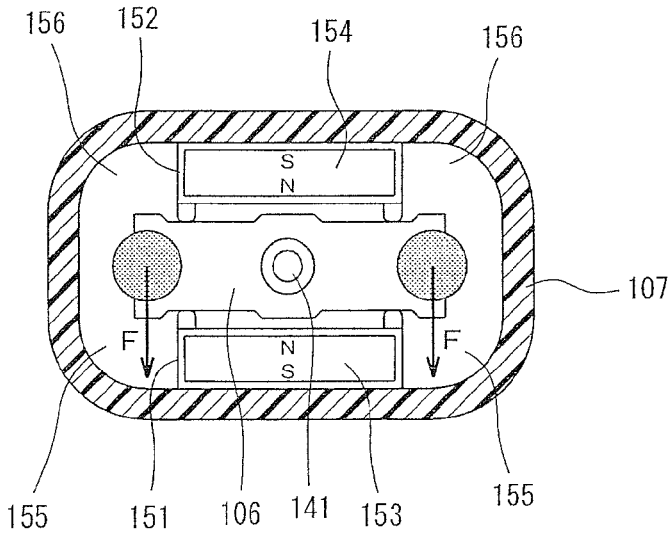

The arcs are greatly extended to the arc extinguishing space 155 sides on the arc extinguishing permanent magnet 153 side by the magnetic fluxes $\phi$ from the arc extinguishing permanent magnets 153 and 154 causing Lorentz forces F acting on the arcs to increase, as shown in FIG. 4C. At this time, as the arc extinguishing spaces 155 and 156 are formed as widely as the thickness of the arc extinguishing permanent magnets 153 and 154, it is possible to obtain a long arc length, and thus possible to reliably extinguish the arcs.

Figure 5A:
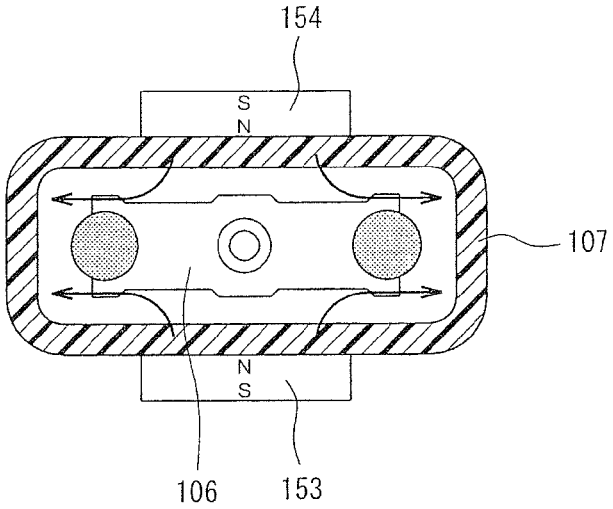
FIG. 5A to 5C are illustrations for illustrating arc extinguishing when the arc extinguishing permanent magnets are disposed on the outer side of an insulating case.
Figure 5B:
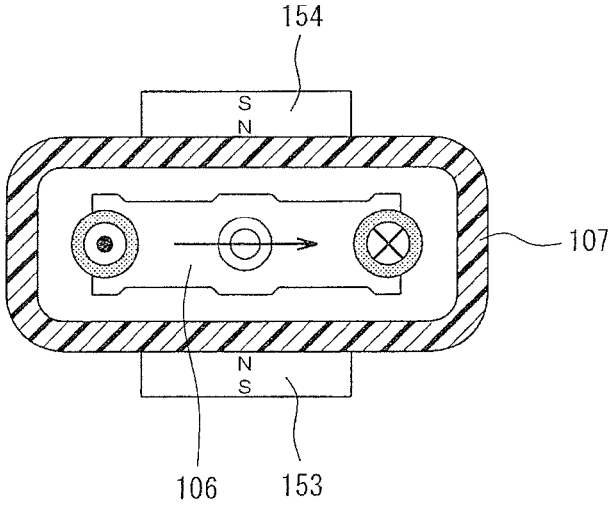
Figure 5C:
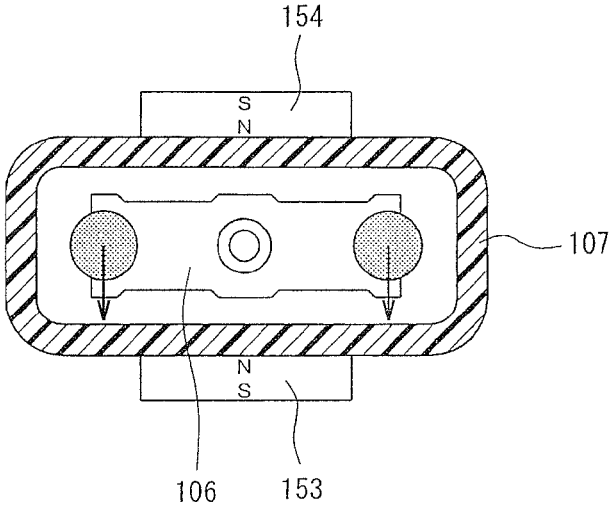

Incidentally, when the arc extinguishing permanent magnets 153 and 154 are disposed on the outer side of the resin cover 107, as shown in FIGS. 5A and 5C, there is an increase in the distance to positions in which the contact portions 104*a* of the fixed contacts 104A and 104B and the contact portions 106*a* of the movable contact 106 are opposed, and when permanent magnets same as those in the embodiment are applied, the density of magnetic fluxes crossing the arcs decreases.

Because of this, Lorentz forces acting on arcs generated when shifting from the closed condition to the released condition, decrease, and it is no longer possible to sufficiently extend the arcs. In order to improve arc extinguishing performance, it is necessary to increase the amount of magnetization of the arc extinguishing permanent magnets 153 and 154.

Moreover, in order to shorten the distance between the arc extinguishing permanent magnets 153 and 154 and the contact portions of the fixed contacts 104A and 104B and movable contact 106, it is necessary to reduce the depth in the front-rear direction of the resin cover 107, and there is a problem that it is not possible to secure sufficient arc extinguishing space to extinguish the arcs.

However, according to the embodiment, as the arc extinguishing permanent magnets 153 and 154 are disposed on the inner side of the resin cover 107, it is possible to solve the problems arising when the arc extinguishing permanent magnets 153 and 154 are disposed on the outer side of the resin cover 107.

The electromagnet device 200, as shown in FIG. 1, has a magnetic yoke 201 with a flattened U-shape relative to the side direction, and a cylindrical auxiliary yoke 203 is fixed in the central portion of a bottom plate portion 202 of the magnetic yoke 201. A spool 204 acting as a plunger drive portion is disposed on the outer side of the cylindrical auxiliary yoke 203.

The spool 204 includes a central cylindrical portion 205 in which the cylindrical auxiliary yoke 203 is inserted, a lower flange portion 206 protruding radially outward from the lower end portion of the central cylindrical portion 205, and an upper flange portion 207 protruding radially outward from slightly below the upper end of the central cylindrical portion 205. Further, an exciting coil 208 is wound in a housing space formed by the central cylindrical portion 205, lower flange portion 206, and upper flange portion 207.

Further, an upper magnetic yoke 210 is fixed between the upper ends, forming the open edge, of the magnetic yoke 201. The upper magnetic yoke 210 has a through hole 210*a*, formed in the central portion thereof, opposite to the central cylindrical portion 205 of the spool 204.

Further, a fixed iron core 211 is disposed fixed on the upper side in the central cylindrical portion 205 of the spool 204, and the movable iron core 212 is disposed on the lower side of the fixed iron core 211 while maintaining a predetermined distance from the fixed iron core 211. A return spring 213 is inserted between the fixed iron core 211 and movable iron core 212, and the movable iron core 212 is pressed downward by the return spring 213. Also, the movable shaft 141 is fixed in the movable iron core 212. The movable shaft 141 is protruded into the contact device 100 through the central axial hole of the fixed iron core 211, and the movable contact 106 is held at the upper end of the movable shaft 141 by the contact spring 142.

Further, the fixed iron core 211 and movable iron core 212 are covered with an open-topped bottomed cylindrical cap 215. A flange portion 216 formed on the open edge of the cap 215 so as to extend radially is seal-joined to the lower surface of the tub-shaped metal body 103 by brazing, welding, or the like. Thereby, a hermetic receptacle, wherein the arc extinguishing container 102 and cap 215 are in communication via the through hole 103*c* of the tub-shaped metal body 103, is formed.

Further, a gas, such as a hydrogen gas, a nitrogen gas, a mixed gas of hydrogen and nitrogen, air, or $SF_6$, is enclosed in the hermetic receptacle formed by the arc extinguishing container 102 and cap 215.

Next, a description will be given of an operation of the heretofore described embodiment.

Firstly, in order to configure the electromagnetic contactor 10, the spool 204 is disposed in the magnetic yoke 201 of the electromagnet device 200. Further, in a condition in which the movable iron core 212 and fixed iron core 211 are inserted in the cap 215 via the return spring 213, the cap 215 is fixed to the tub-shaped metal body 103 by brazing, welding, or the like. At this time, the fixed iron core 211 is fixed in the insertion hole 103*c* of the tub-shaped metal body 103, and the lower side position of the movable shaft 141 is restricted by the positioning piece 111 being fixed in the central portion of the tub-shaped metal body 103.

Meanwhile, for the contact device 100, the insulating holding member 105 is inserted and held in the tub-shaped metal body 103. The U-shaped bend portions 104*b* of the pair of fixed contacts 104A and 104B are inserted and held in the contact holding portions 105*b* and 105*c* of the insulating holding member 105 so that the contact portions 104*a* are inward. In this condition, the contact portions 104*a* of the pair of fixed contacts 104A and 104B are opposed from above to the contact portions 106*a* of the movable contact 106.

Further, an adhesive agent is injected into the U-shaped bend portions 104*b* of the pair of fixed contacts 104A and 104B, as shown in FIG. 1, and an adhesive agent is applied to the lower surface side of the peripheral flange portion 107*a* of the resin cover 107. In this condition, the peripheral flange portion 107*a* is brought into abutment with the bottom plate portion 103*a* of the tub-shaped metal body 103 from above so that the bottom plate portions of the U-shaped bond portions 104*b* of the pair of fixed contacts 104A and 104B are inserted in the notch portions 107*b* of the resin cover 107.

Thereby, the adhesive agent adheres the peripheral flange portion 107*a* to the bottom plate portion 103*a* of the tub-shaped metal body 103, and the adhesive agent adheres the bottom plate portions of the U-shaped bend portions 104*b* of the pair of fixed contacts 104A and 104B to the notch portions 107*b* of the resin cover 107. In this way, a sealed arc extinguishing chamber is formed by the tub-shaped metal body 103, resin cover 107, and cap 215.

Subsequently, in a condition in which the adhesive agents are solidified, a gas, such as a hydrogen gas, a nitrogen gas, a mixed gas of hydrogen and nitrogen, air, or $SF_6$, is injected from an unshown gas injection hole formed in the resin cover 107, and the gas injection hole is sealed after the gas injection. Thereby, it is possible to configure the electromagnetic contactor 10.

For the electromagnetic contactor 10 formed in this way, for example, a power supply source which supplies a large current is connected to the connection terminal portion 104*c* of the fixed contact 104A, and a load is connected to the connection terminal portion 104*c* of the fixed contact 104B.

It is assumed, in this condition, that an exciting coil 208 in the electromagnet device 200 is in a non-excited state, and that a released condition in which no exciting force that causes the movable iron core 212 to ascend is generated in the electromagnetic device 200, is attained. In the released condition, the movable iron core 212 is biased by the return spring 213 in a downward direction away from the fixed iron core 211.

Because of this, the contact portions 106*a* of movable contact 106 of the contact mechanism 101 connected to the movable iron core 212 via the movable shaft 141 are spaced with a predetermined distance downward from the contact portions 104*a* of the fixed contacts 104A and 104B. Because of this, the current path between the fixed contacts 104A and 104B is in an interrupted condition, and the contact mechanism 101 is in an opened contact condition.

In this way, as the biasing force of the return spring 213 acts on the movable iron core 212 in the released condition, it does not happen that the movable iron core 212 descends unexpectedly due to external vibration, shock, or the like, and it is thus possible to reliably prevent malfunction.

On the exciting coil 208 of the electromagnet device 200 excited in the released condition, an exciting force is generated in the electromagnet device 200, and the movable iron core 212 is pressed upward against the biasing force of the return spring 213.

At this time, a magnetic path is formed between the movable iron core 212 and the bottom plate portion 202 of the magnetic yoke 201 through the cylindrical auxiliary yoke 203. Because of this, the density of magnetic fluxes between the upper surface of the movable iron core 212 and the lower surface of the fixed iron core 211 increases, and a large attraction force which attracts the movable iron core 212 acts.

Consequently, the movable iron core 212 ascends promptly against the biasing force of the return spring 213. Then, the ascent of the movable iron core 212 is stopped by the upper end of the movable iron core 212 coming into abutment with the lower end of the fixed iron core 211.

By the movable iron core 212 ascending in this way, the movable contact 106 linked to the movable iron core 212 via the movable shaft 141 also ascends, and the contact portions 106*a* of the movable contact 106 come into contact with the contact portions 104*a* of the fixed contacts 104A and 104B with the contact pressure of the contact spring 142.

Because of this, a closed contact condition in which the large current of the external power supply source is supplied to the load through the fixed contact 104A, movable contact 106, and fixed contact 104B, is attained.

At this time, electromagnetic repulsion forces are generated between the fixed contacts 104A and 104B and the movable contact 106 in a direction such as to cause the contacts of the movable contact 106 to open.

Because of this, it is possible to cause magnetic fluxes generated by the current flowing through the vertical plate portions of the L-shaped portions of the fixed contacts 104A and 104B to act on the contact portions of the fixed contacts 104A and 104B and movable contact 106. Because of this, it is possible to increase the density of magnetic fluxes in the contact portions of the fixed contacts 104A and 104B and movable contact 106 and thus possible to generate Lorentz forces against the electromagnetic repulsion forces.

Due to the Lorentz forces, it is possible to oppose the electromagnetic repulsion forces generated in the contact opening direction between the contact portions 104*a* of the fixed contacts 104A and 104B and the contact portions 106*a* of the movable contact 106, and thus possible to reliably prevent the contact portions 106*a* of the movable contact 106 from opening.

Because of this, it is possible to reduce the pressing force of the contact spring 142 supporting the movable contact 106, and as a result, it is also possible to reduce thrust generated in the exciting coil 208, and it is thus possible to reduce the size of the overall configuration of the electromagnetic contactor.

When interrupting the supply of current to the load in the closed contact condition of the contact mechanism 101, the excitation of the exciting coil 208 of the electromagnet device 200 is stopped.

Thereby, the exciting force causing the movable iron core 212 to move upward in the electromagnet device 200 stops, and as a result, the movable iron core 212 descends by the biasing force of the return spring 213.

By the movable iron core 212 descending, the movable contact 106 linked via the movable shaft 141 descends. As a result of this, the movable contact 106 is in contact with the fixed contacts 104A and 104B for as long as contact pressure is applied by the contact spring 142. Subsequently, an opened contact condition in which the movable contact 106 moves downward away from the fixed contacts 104A and 104B is attained at the point at which the contact pressure of the contact spring 142 stops.

On the opened contact condition, arcs are generated between the contact portions 104*a* of the fixed contacts 104A and 104B and the contact portions 106*a* of the movable contact 106, and the condition in which current is conducted is continued owing to the arcs.

At this time, as the opposing magnetic pole faces of the arc extinguishing permanent magnets 153 and 154 are N-poles, and the outer sides thereof are S-poles, the magnetic flux emanating from the N-pole of each of the arc extinguishing permanent magnets 153 and 154, in plan view as shown in FIG. 4A, crosses an arc generation portion of a portion in which the contact portion 104*a* of the fixed contact 104A and the contact portion 106*a* of the movable contact 106 are opposed, from the inner side to the outer side in a longitudinal direction of the movable contact 106, and reaches the S-pole, thus forming a magnetic field.

In the same way, the magnetic flux crosses an arc generation portion of the contact portion 104*a* of the fixed contact 104B and the contact portion 106*a* of the movable contact 106, from the inner side to the outer side in the longitudinal direction of the movable contact 106, and reaches the S-pole, thus forming a magnetic field.

Consequently, the magnetic fluxes of the arc extinguishing magnets 153 and 154 both cross between the contact portion 104*a* of the fixed contact 104A and the contact portion 106*a* of the movable contact 106, and between the contact portion 104*a* of the fixed contact 104A and the contact portion 106*a* of the movable contact 106, in mutually opposite directions in the longitudinal direction of the movable contact 106.

Because of this, a current I flows from the fixed contact 104A side to the movable contact 106 side between the contact portion 104*a* of the fixed contact 104A and the contact portion 106*a* of the movable contact 106, as shown in FIG. 4A, and the orientation of the magnetic fluxes $\phi$ is in a direction from the inner side toward the outer side. Consequently, in accordance with Fleming's left-hand rule, large Lorentz forces F act toward the arc extinguishing space 155 side, perpendicular to the longitudinal direction of the movable contact 106 and perpendicular to the switching direction of the contact portion 104*a* of the fixed contact 104A and the movable contact 106, as shown in FIG. 4C.

Due to the Lorentz force F, an arc generated between the contact portion 104*a* of the fixed contact 104A and the contact portion 106*a* of the movable contact 106 is greatly extended so as to pass from the side surface of the contact portion 104*a* of the fixed contact 104A through inside the arc extinguishing space 155 and reach the upper surface side of the movable contact 106, and is extinguished.

Also, at the lower side and upper side of the arc extinguishing space 155, a magnetic flux inclines to the lower side and upper side with respect to the orientation of the magnetic flux between the contact portion 104*a* of the fixed contact 104A and the contact portion 106*a* of the movable contact 106. Because of this, the arc extended to the arc extinguishing space 155 is further extended by the inclined magnetic flux in the direction of the corner of the arc extinguishing space 155, and it is possible to increase the arc length, and thus possible to obtain good interruption performance.

Meanwhile, the current I flows from the movable contact 106 side to the fixed contact 104B side between the contact portion 104*a* of the fixed contact 104B and the movable contact 106, and the orientation of the magnetic flux $\phi$ is in a rightward direction from the inner side toward the outer side, as shown in FIG. 4B.

Because of this, in accordance with Fleming's left-hand rule, a large Lorentz force F acts toward the arc extinguishing space 155 side, perpendicular to the longitudinal direction of the movable contact 106 and perpendicular to the switching direction of the contact portion 104*a* of the fixed contact 104B and the movable contact 106.

Due to the Lorentz force F, an arc generated between the contact portion 104*a* of the fixed contact 104B and the movable contact 106 is greatly extended so as to pass from the upper surface side of the movable contact 106 through inside the arc extinguishing space 155 and reach the side surface side of the fixed contact 104B, and is extinguished.

Also, at the lower side and upper side of the arc extinguishing space 155, as heretofore described, a magnetic flux inclines to the lower side and upper side with respect to the orientation of the magnetic flux between the contact portion 104*a* of the fixed contact 104B and the contact portion 106*a* of the movable contact 106.

Because of this, the arc extended to the arc extinguishing space 155 is further extended by the inclined magnetic flux in the direction of the corner of the arc extinguishing space 155, and it is possible to increase the arc length, and thus possible to obtain good interruption performance.

Meanwhile, in the closed condition of the electromagnetic contactor 10, when attaining the released condition in a condition in which a regenerative current flows from the load side to the direct current power source side, as the previously described direction of current in FIG. 4B is reversed, excepting that the Lorentz forces F act on the arc extinguishing space 156 sides, and the arcs are extended to the arc extinguishing space 156 sides, the same arc extinguishing function is fulfilled.

At this time, as the arc extinguishing permanent magnets 153 and 154 are disposed in the magnet holding portions 151 and 152 formed in the insulating holding member 105, it does not happen that the arcs come into direct contact with the arc extinguishing permanent magnets 153 and 154. Because of this, it is possible to stably maintain the magnetic characteristics of the arc extinguishing permanent magnets 153 and 154, and thus possible to stabilize interruption performance.

Also, the tub-shaped metal body 103 and resin cover 107 are fixed by the adhesive agent, and in the same way, the resin cover 107 and the U-shaped bend portions 104*b* of the pair of fixed contacts 104A and 104B are also fixed by the adhesive agent. Because of this, it is possible to fix the tub-shaped metal body 103 and resin cover 107 without carrying out brazing, welding, or the like. Consequently, as it is not necessary to apply heat in fixing the tub-shaped metal body 103 and resin cover 107, there occurs no thermal deformation or thermal stress, and it is possible to carry out good sealing.

Also, as it is possible to cover and insulate the inner peripheral surface of the tub-shaped metal body 103 with the insulating holding member 105 and resin cover 107, there is no short circuiting of the arcs when the current is interrupted, and it is thus possible to reliably carry out current interruption.

Furthermore, as it is possible to carry out the insulating function, the function of positioning the arc extinguishing permanent magnets 153 and 154, and the function of protecting the arc extinguishing permanent magnets 153 and 154 from the arcs, using the insulating holding member 105 and resin cover 107, it is possible to reduce manufacturing cost.

In this way, according to the embodiment, in the contact device 100, the arc extinguishing container 102 includes the tub-shaped metal body 103, the insulating holding member 105 which supports the pair of fixed contacts 104A and 104B disposed on the upper surface side of the bottom plate portion 103*a* of the tub-shaped metal body 103, and the resin cover 107 which covers the pair of fixed contacts 104A and 104B, the movable contact 106, and the arc extinguishing permanent magnets 153 and 154. Further, the tub-shaped metal body 103 and resin cover 107 are fixed by the adhesive agent, and the resin cover 107 and the pair of fixed contacts 104A and 104B is also held fixed by the adhesive agent.

Because of this, it is possible to adhere the tub-shaped metal body 103 and resin cover 107 in an airtight condition by the adhesive agent. Consequently, it is not necessary to apply expensive ceramics to an arc extinguishing container, and it is possible to drastically reduce the fabrication cost of the arc extinguishing container 102. Moreover, as it is not necessary carry out brazing, welding, or the like, and it is only necessary to fix using an adhesive agent, in order to maintain airtightness, it is possible to reliably prevent thermal deformation or thermal stress from occurring.

Also, in the embodiment, as the contact portion 104*a*, U-shaped bend portion 104*b*, and connection terminal portion 104*c* of each of the pair of fixed contacts 104A and 104B are integrally formed, it is possible to easily fabricate the fixed contacts 104A and 104B at low cost.

Also, as the arc extinguishing permanent magnets 153 and 154 are disposed on the inner side of the resin cover 107, it is possible to increase the density of magnetic fluxes crossing arcs, and to form the arc extinguishing spaces 155 and 156 as widely as the thickness of the arc extinguishing permanent magnets 153 and 154, and it is possible to obtain a long arc length, and thus possible to reliably extinguish the arcs.

Also, it is possible to move the movable contact 106 of the contact device 100 with the electromagnet device 200, and it is possible to easily configure the electromagnetic contactor.

In embodiment, a description has been given of a case in which the fixed contacts 104A and 104B forming the contact mechanism 101 are formed in an L-shape in the vicinity of the movable contact 106, but the invention is not limited to the configuration of the embodiment, and it is also possible to form the fixed contacts 104A and 104B in a C-shape so as to sandwich the movable contact 106 from above and below, and it is possible to apply a contact mechanism of any other configuration.

Also, in the embodiment, a description has been given of a case in which a hermetic receptacle includes the arc extinguishing container 102 and cap 215, and a gas is enclosed in the hermetic receptacle, but the invention is not limited to this, and gas charging may be omitted when a current to be interrupted is low.

Also, in the embodiment, a description has been given of a case in which the arc extinguishing permanent magnets 153 and 154 are disposed on the inner peripheral surface of the resin cover 107. However, the invention is not limited to the heretofore described configuration, and the arc extinguishing permanent magnets may be disposed on the outer peripheral surface of the resin cover 107, and furthermore, the arc extinguishing permanent magnets 153 and 154 may be omitted.

Also, in the embodiment, a description will be given of a case in which the electromagnet device 200 has the U-shaped magnetic yoke 201, but a bottomed cylindrical magnetic yoke may be applied, and it is possible to apply any configuration wherein the movable contact 106 can be moved so as to be able to come into and out of contact with the fixed contacts 104A and 104B.

Also, in the embodiment, a description has been given of a case in which the invention is applied to an electromagnetic contactor, but the invention, not limited to this, can be applied to an electromagnetic relay and a switch having an arc extinguishing container such as a switch.

INDUSTRIAL APPLICABILITY

According to the invention, it is possible to provide a switch, such as an electromagnetic contactor, wherein it is possible to easily mold an arc extinguishing container, which seals a contact mechanism in a condition in which the arc extinguishing container is enclosing the contact mechanism, simply by adhering a tub-shaped metal body and a resin cover with an adhesive agent without carrying out a joining process necessary for heating, such as projection welding, laser welding, or brazing.

REFERENCE SIGNS LIST

10 . . . Electromagnetic contactor, 11 . . . Exterior insulating container, 100 . . . Contact device, 101 . . . Contact mechanism, 102 . . . Arc extinguishing container, 103 . . . Tub-shaped metal body, 104A, 104B . . . Fixed contact, 104*a* . . . Contact portion, 104*b* . . . U-shaped bend portion, 104*c* . . . Connection terminal portion, 105 . . . Insulating holding member, 105*b*, 105*c* . . . Contact holding portion, 106 . . . Movable contact, 106*a* . . . Contact portion, 107 . . . Resin cover, 107*a* . . . Peripheral flange portion, 107*b* . . . Notch portion, 141 . . . Movable shaft, 142 . . . Contact spring, 151, 152 . . . Magnet holding portion, 153, 154 . . . Arc extinguishing permanent magnet, 155, 156 . . . Arc extinguishing space, 200 . . . Electromagnet device, 201 . . . Magnetic yoke, 203 . . . Cylindrical auxiliary yoke, 204 . . . Spool, 208 . . . Exciting coil, 210 . . . Upper magnetic yoke, 211 . . . Fixed iron core, 212 . . . Movable iron core, 213 . . . Return spring, 215 . . . Cap

What is claimed is:

1. A switch comprising:

an arc extinguishing container;

a pair of fixed contacts disposed to maintain a predetermined space therebetween; and a movable contact disposed so as to come into and out of contact with the pair of fixed contacts, the pair of fixed contacts and the movable contact being installed in the arc extinguishing container, wherein the arc extinguishing container includes:

an open-topped tub-shaped metal body, an insulating holding member disposed on an inner side of the tub-shaped metal body, and having contact holding portions holding the pair of fixed contacts opposite to the movable contact, and a cylindrical portion integrally formed inside the contact holding portions, and an open-bottomed tub-shaped resin cover which covers the pair of fixed contacts and the movable contact from an open edge face side of the tub-shaped metal body; and a periphery of an open edge of the resin cover is arranged between the open-topped tub-shaped metal body and the cylindrical portion, and an adhesive agent layer is formed at the periphery of the open edge of the resin cover.

2. The switch according to claim 1, wherein each of the pair of fixed contacts has a U-shaped bend portion formed between a contact portion opposite to the movable contact and an external connection terminal portion, the U-shaped bend portions of the pair of fixed contacts are inserted and held in the contact holding portions, and the resin cover is inserted in the U-shaped bend portions of the pair of fixed contacts and fixed by the adhesive agent with side surfaces of the resin cover.

3. The switch according to claim 1, wherein an electromagnet device which moves the movable contact such that the movable contact comes into and out of contact with the pair of fixed contacts, is disposed on a lower surface side of the tub-shaped metal body.

4. The switch according to claim 1, wherein each of the contact holding portions includes an outer side tub-shaped portion arranged inside the open-topped tub-shaped metal body, an inner side tub-shaped portion arranged inwardly apart from the outer side tub-shaped portion and forming a part of the cylindrical portion, and a bottom plate portion extending between the outer side tub-shaped portion and the inner side tub-shaped portion; and the cylindrical portion includes the inner side tub-shaped portions, and sidewall portions integrally formed with the inner side tub-shaped portions and outwardly bulging from the inner side tub-shaped portions so that the cylindrical portion entirely surrounds a lower part of the arc extinguishing container.

5. The switch according to claim 4, wherein each of the pair of fixed contacts has a U-shaped bend portion, formed between a contact portion opposite to the movable contact and an external connection terminal portion and held in a space formed by the outer side tub-shaped portion, the inner side tub-shaped portion and the bottom plate portion; and the open-bottomed tub-shaped resin cover includes notch portions formed at the open edge of the open-bottomed tub-shaped resin cover to hold the U-shaped bend portions of the pair of fixed contacts in the notch portions.

6. A switch comprising:

a pair of fixed contacts disposed to maintain a predetermined space therebetween; and a movable contact disposed so as to come into and out of contact with the pair of fixed contacts, the pair of fixed contacts and the movable contact being installed in an arc extinguishing container, wherein the arc extinguishing container includes an open-topped tub-shaped metal body, an insulating holding member disposed on an inner side of the tub-shaped metal body and holding the pair of fixed contacts opposite to the movable contact, and an open-bottomed tub-shaped resin cover which covers the pair of fixed contacts and the movable contact from an open edge face side of the tub-shaped metal body, a periphery of an open edge of the resin cover is sealed to a bottom surface of the tub-shaped metal body with an adhesive agent, and the insulating holding member is formed with magnet holding portions which hold arc extinguishing permanent magnets so as to be opposite to the contact portions of the pair of fixed contacts and the contact portions of the movable contacts.

* * * * *